US005332229A

United States Patent [19]

Fielder et al.

[11] Patent Number: 5,332,229

[45] Date of Patent: Jul. 26, 1994

[54] BOARD GAME APPARATUS

[76] Inventors: Phillip D. Fielder; Shelley L. Fielder, both of 1411 McEwen St., Burton, Mich. 48509

[21] Appl. No.: 96,899

[22] Filed: Jul. 26, 1993

[51] Int. Cl.[5] ..... A63F 3/00

[52] U.S. Cl. ..... 273/271; 273/264; 273/269; 273/290; 273/292

[58] Field of Search ..... 273/264, 269, 260, 275, 273/274, 271, 290, 288, 292

[56] References Cited

U.S. PATENT DOCUMENTS 1,605,703 11/1926 Brown ..... 273/290
4,302,015 11/1981 Bowser et al. ..... 273/271
5,029,871 7/1991 Willson, Jr. et al. ..... 273/271

*Primary Examiner*—Vincent Millin
*Assistant Examiner*—William M. Pierce
*Attorney, Agent, or Firm*—E. Michael Combs

[57] ABSTRACT

A board game is arranged to include a game board having a plurality of sets of spaces, with the game board of a rectilinear configuration associating spaces with cards of a conventional solitaire type playing card of a plurality of decks of such cards, wherein indication of obtaining a playing card is indicated upon the game board and upon a sequence of a row of spaces, a "run" is obtained, wherein a player to obtain a greatest number of "runs" after a predetermined time interval is declared a winner.

1 Claim, 5 Drawing Sheets

BOARD GAME APPARATUS

BACKGROUND OF THE INVENTION

1. Field of the Invention

The field of invention relates to game apparatus, and more particularly pertains to a new and improved board game apparatus wherein the same is directed to the operative association of a game board with a plurality of decks of playing cards and tokens to effect operative association of the playing cards and game board.

2. Description of the Prior Art

Game board apparatus of various types utilizing tokens and cards and the like are available in the prior art and exemplified by the U.S. Pat. Nos. 3,514,110; 4,362,302; 4,272,081; 4,936,588; and 4,984,806.

The instant invention attempts to overcome deficiencies of the prior art by providing a board game apparatus to provide for operative association of playing cards and a game board to effect inter-relationship of the playing cards, game board, and indicator tokens in an operative relationship and in this respect, the present invention substantially fulfills this need.

SUMMARY OF THE INVENTION

In view of the foregoing disadvantages inherent in the known types of board game apparatus now present in the prior art, the present invention provides a board game apparatus wherein the same is directed to operatively associate playing cards and a game board in competitive play among various players. As such, the general purpose of the present invention, which will be described subsequently in greater detail, is to provide a new and improved board game apparatus which has all the advantages of the prior art board game apparatus and none of the disadvantages.

To attain this, the present invention provides a board game arranged to include a game board having a plurality of sets of spaces, with the game board of a rectilinear configuration associating spaces with cards of a conventional solitaire type playing card of a plurality of decks of such cards, wherein indication of obtaining a playing card is indicated upon the game board and upon a sequence of a row of spaces, a "run" is obtained, wherein a player to obtain a greatest number of "runs" after a predetermined time interval is declared a winner.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game apparatus which has all advantages of the prior art board game apparatus and none of the disadvantages.

It is another object of the present invention to provide a new and improved board game apparatus which may be easily and efficiently manufactured and marketed.

It is a further object of the present invention to provide a new and improved board game apparatus which is of a durable and reliable construction.

An even further object of the present invention is to provide a new and improved board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new and improved board game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
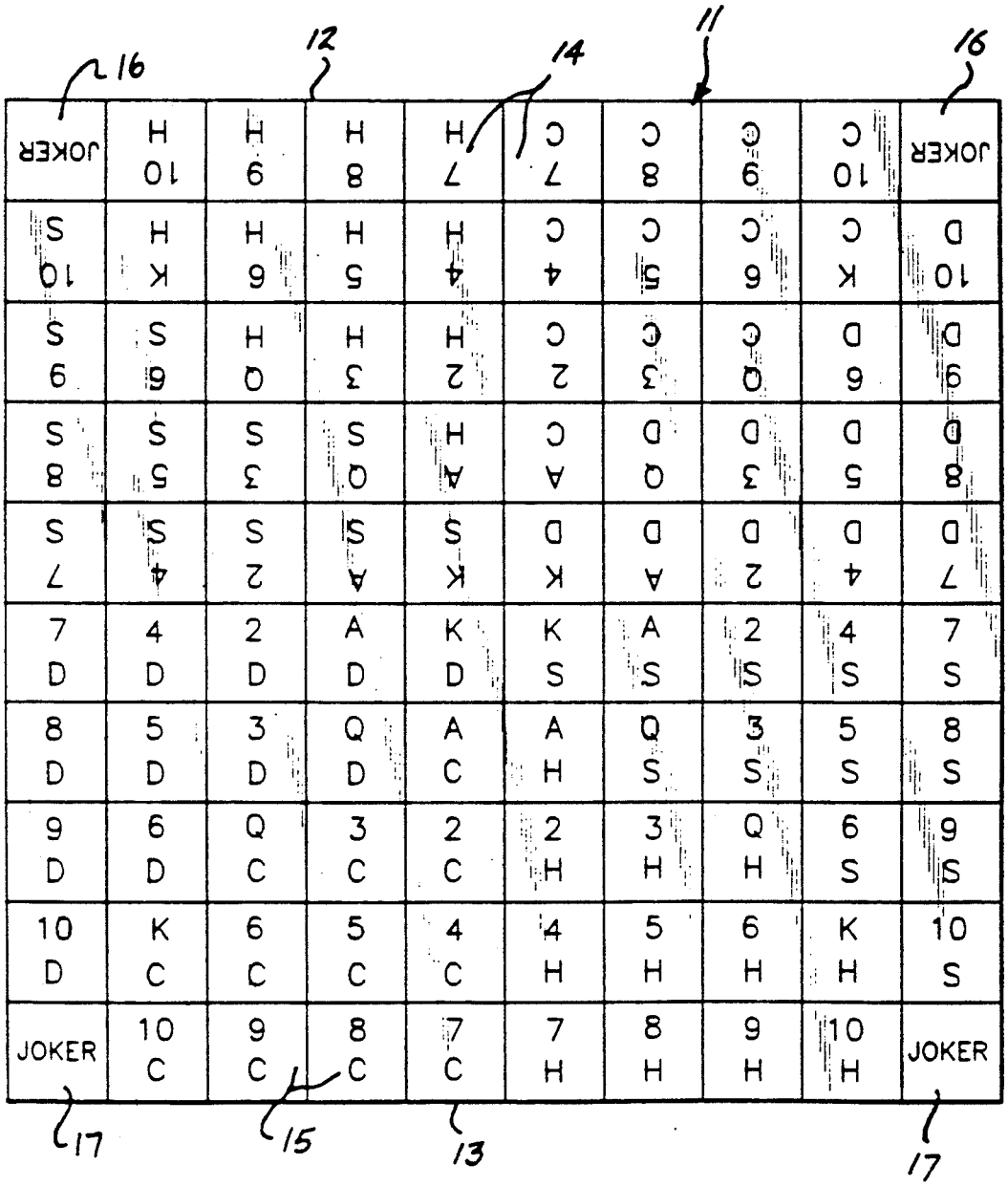
FIG. 1 is an orthographic top view of the game board of the invention.
Figure 2:
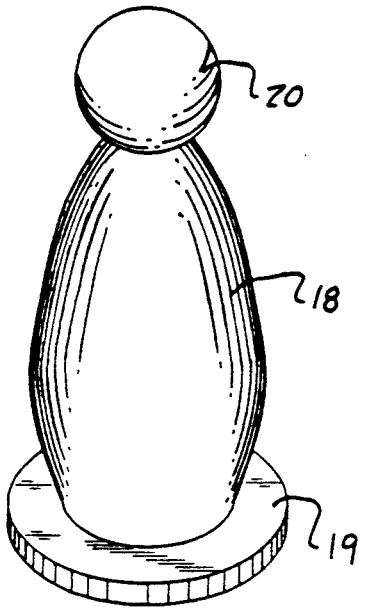
FIG. 2 is an isometric illustration of a token member for optional use by the invention.
Figure 3:
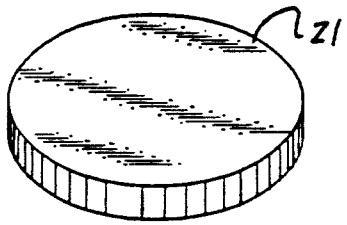
FIG. 3 is an isometric illustration of a playing chip as utilized by the invention.
Figure 4:
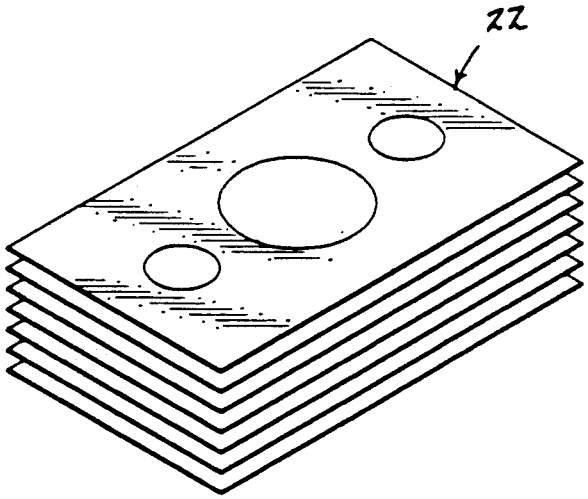
FIG. 4 is an isometric illustration of an example of a playing card deck as employed by the invention.
Figure 5:
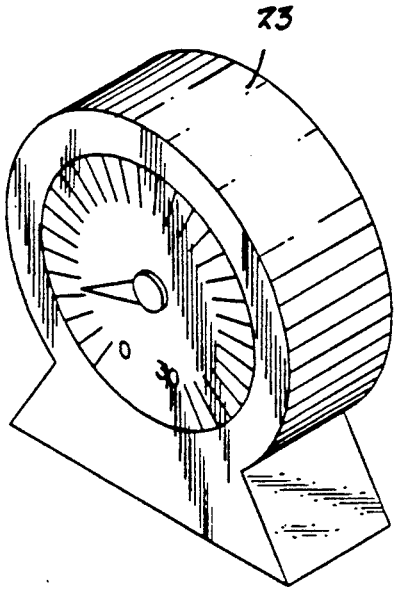
FIG. 5 is an isometric illustration of a timer mechanism.

With reference now to the drawings, and in particular to FIGS. 1 to 12 thereof, a new and improved board game apparatus embodying the principles and concepts of the present invention and generally designated by the reference numerals 11–29 will be described.

More specifically, the board game apparatus of the instant invention essentially comprises a game board 11 of a generally square configuration, having a first end 12 spaced from a second end 13, with a matrix of first spaces 14 extending medially of the game board to the first end 12, with a matrix of second spaces 15 extending medially of the game board and from the first spaces 14 to the second end 13. The first spaces 14 include first "joker or wild" spaces 16 at the corners at the first end 12, wherein second corner "wild" spaces 17 are oriented at the corners of the second end 13. The respective first and second spaces 14 and 15 are indicated to associate with a solitaire type deck of playing cards of conventional fifty-two card construction, such as indicated by the playing card deck 22. A token 18 having a token base 19 and a token head 20 may be employed to indicate association of an individual card of the card deck 22 at an individual space of the first and second spaces 14 and 15, or alternatively, a simple playing chip 21 may be employed. A timer mechanism 23 is provided to provide for indication of a predetermined timed interval as agreed upon by players in play of the game.

Figure 6:
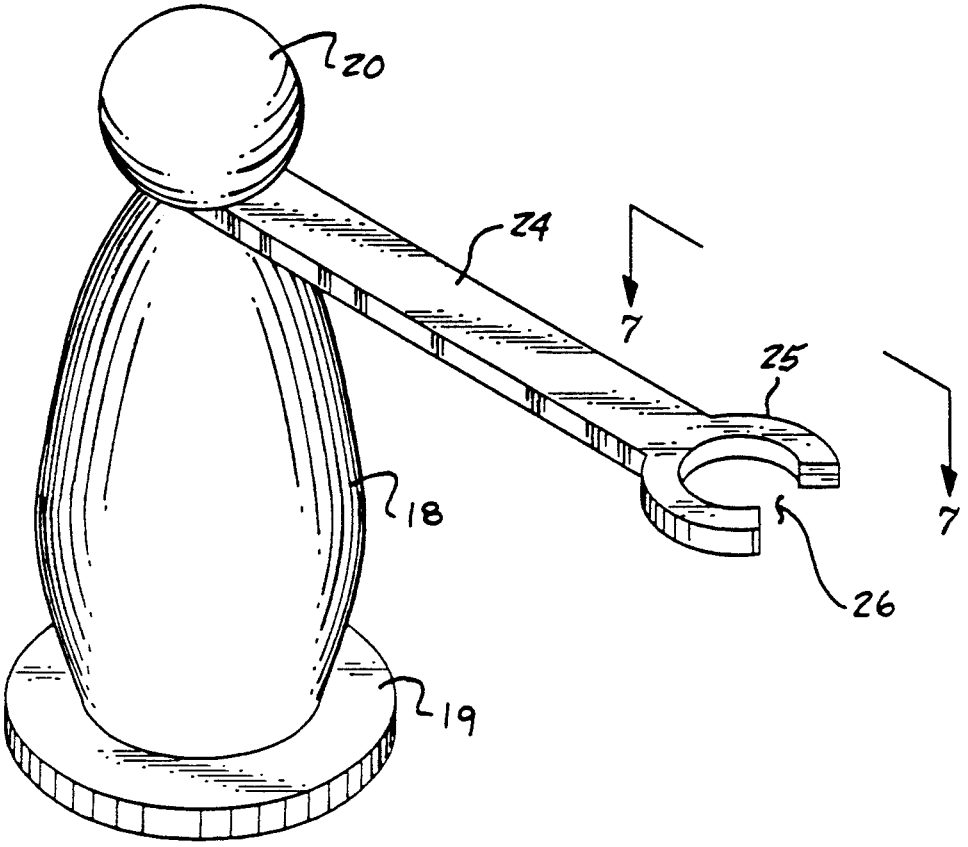
FIG. 6 is an isometric illustration of a modified token structure.
Figure 7:
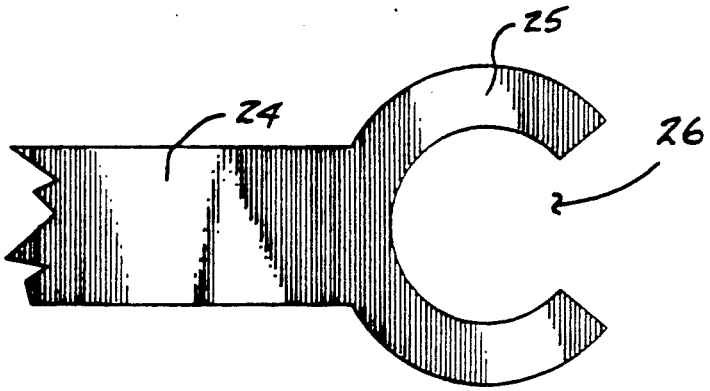
FIG. 7 is an orthographic view, taken along the lines 7—7 of FIG. 6 in the direction indicated by the arrows.
Figure 8:
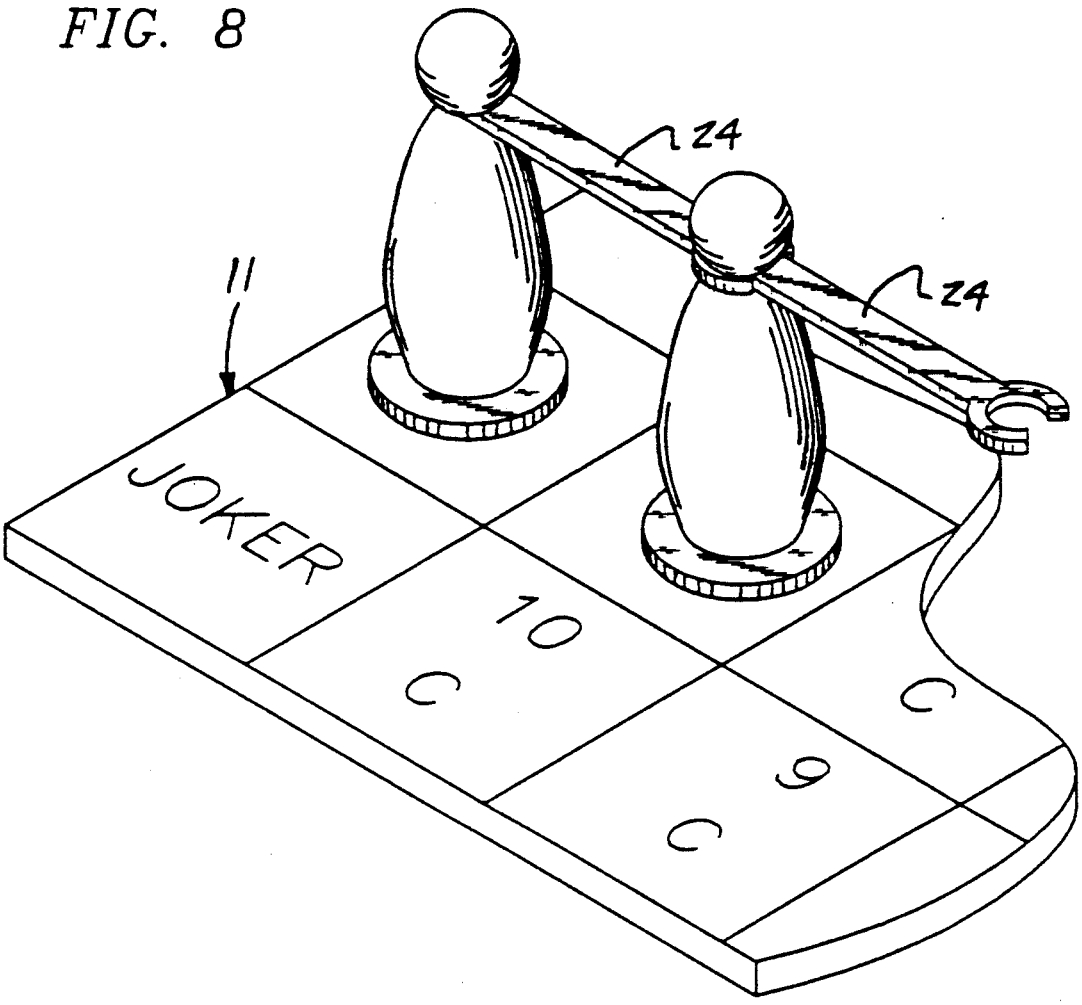
FIG. 8 is an isometric illustration of the modified tokens employed upon the game board.
Figure 9:
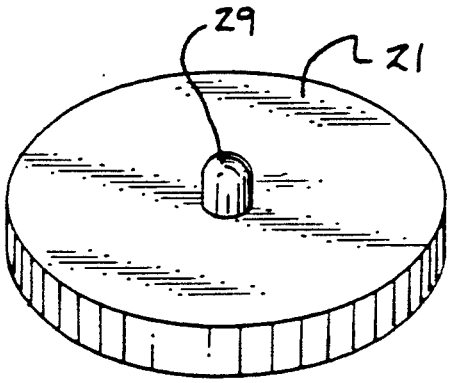
FIG. 9 is an isometric illustration of a modified token chip.
Figure 10:
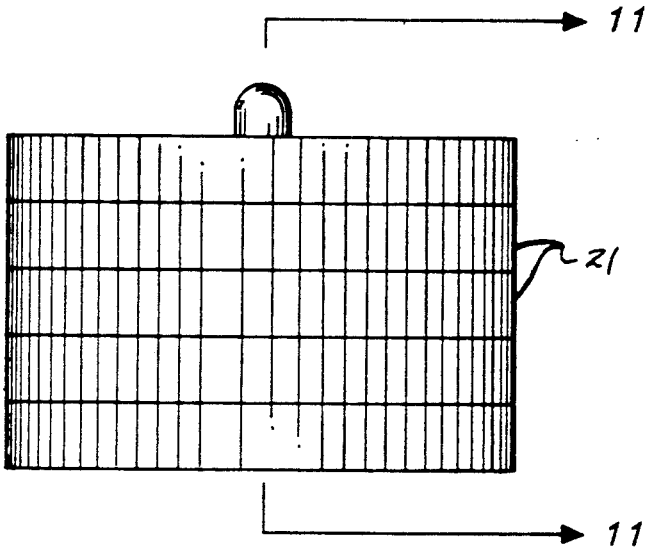
FIG. 10 is an orthographic view of a stack of playing chips.
Figure 11:
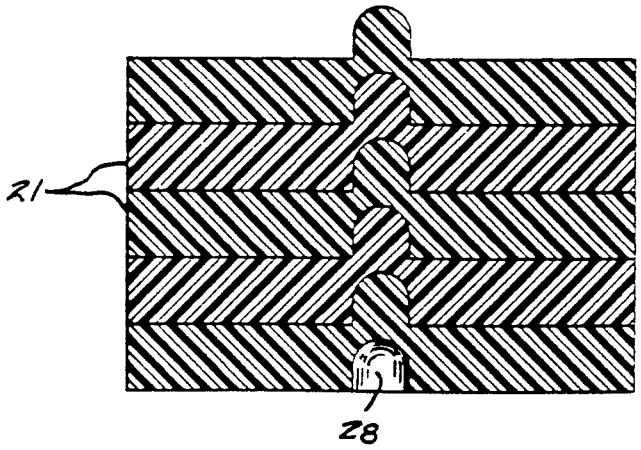
FIG. 11 is an orthographic view, taken along the lines 11—11 of FIG. 10 in the direction indicated by the arrows.
Figure 12:
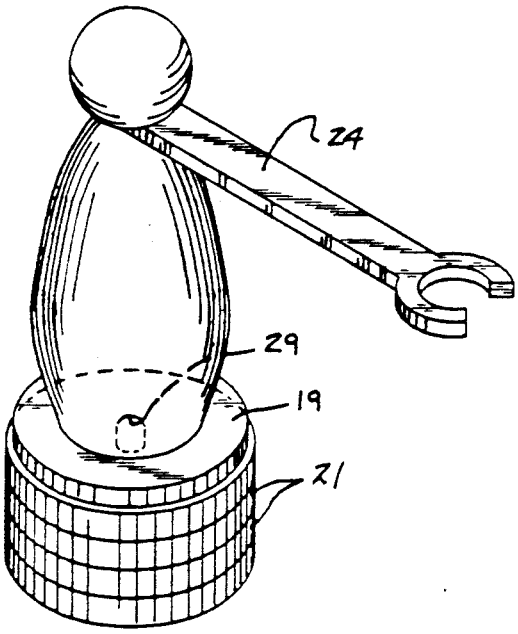
FIG. 12 is an isometric illustration of the modified token member employing the token chips, as indicated in the FIGS. 10 and 11.

The FIG. 6 indicates a modified token structure to include a rigid connecting web 24 having a predetermined width, with the web 24 terminating in a resilient C-shaped connector end 25 defining an arc greater than 180 degrees and having an entrance gap 26 oriented between arcuate arms, wherein the entrance gap 26 is of a predetermined spacing substantially equal to the predetermined width to permit end-to-end securement of the tokens 18, in manner as indicated in the FIG. 8, to provide for securement and association of a "run" of the tokens, in a manner to be described in more detail below. The playing chips 21 may include a playing chip projection 27 to a chip top surface, with a playing chip recess 28 oriented with a chip bottom wall for reception of an associated and underlying playing chip projections 27, wherein a stack of such playing chips may be mounted by the token base 19 having a token base recess 29 directed through a bottom wall thereof to provide for indication of plural runs along a single row of the first or second spaces 14 and 15.

OBJECTIVE OF THE GAME

The objective of the game is to complete a certain of "runs" of individual or team tokens 18, or alternatively playing chips 21 in a specified predetermined time interval to be determined by the individual players or teams of players.

EQUIPMENT

The equipment includes the game board 11, with at least fifty of the playing chips 21 of a contrasting coloration relative to a further set of such chips being afforded each player or team of players. Typically, three such sets are provided. Game tokens 18 are typically in terms of twenty-five, and typically three of the playing card decks 22 are afforded, with each of the playing card decks of a conventional fifty-two card solitaire type configuration. The time mechanism 23 is of a thirty second timer to control play of individuals and their respective turns.

PREPARATION

Subsequent to distribution of the playing chips 21, the decks of cards are shuffled as a unit and subsequently they are dealt to the individual players one card at a time to each of the players until all players or teams thereof are afforded five cards. The remaining cards of the card decks are divided into subgroups in an equal number relative to the number of players, and the players in turn select a subgroup such that each of the players or teams thereof have their own subgroup of cards for use. Card selection by each player or team thereof is then obtained from that subgroup afforded that player or team.

GAME PLAY

A game is considered won when a player or team thereof completes one or a plurality of "runs" of respective playing chips 21. At the start of each game, all players agree to the amount of such runs required for winning of that game. Additional difficulty in obtaining wins may be attained by employing less than three card decks limiting the number of available cards in association with the spaces 14 and 15 of the game board 11.

THE RUN

A run comprises five of the playing chips 21 oriented in alignment relative to one another, either parallel to the sides of the game board or oriented diagonally thereof, such that a run is to include five chips in such a linear array. One run of such chips may intersect with another such run but only for an individual player or team, wherein opposing teams or players may not share chips that intersect in runs. Runs are not to share a chip if they are in an end-to-end or linear type orientation relative to one another. To this end, each of such runs must include the requisite number of five such chips. Once a run has been completed, a wild card is not able to remove any of the five chips. To this end, it should be understood that the four jacks of each of the playing decks 22 are considered wild cards, wherein the one-eyed jacks permit removal of an opposing player's chip. In the event that a run is made of six or more chips, the player or team must declare which five chips are to be utilized for that particular run.

CARDS

As noted, the cards are played at face value of the playing deck or decks 22, and as noted a one-eyed jack is employed for removing one of the opposing player's playing chips 21 from the game board 11. A two-eyed jack is employed for placing one team chip of a player chip 21 with any of the unoccupied space of the board. This is also a complete move, and again it is the next player's turn as play is undertaken sequentially among the players in drawing cards from the aforenoted sub-sets of cards. In the event that both of the corresponding scores on the board are occupied and a player has that card in hand, that card may be discarded into a discard pile and a new card obtained from a subgroup of such cards or sub-set. During game play, if a player employs all and utilizes cards of a subgroup, a few cards may be taken from the bottom of other player's sub-sets and repeated as often as necessary until the game is finished.

Typically, thirty seconds is provided for a time limit for each player to take a turn as directed by the timer member 23. If no play is made than that player forfeits a turn and a subsequent player takes a turn in a corresponding manner as noted. If desired, "runs" may be only vertical or horizontal or diagonal, depending upon player selection to increase difficulty in play or only the first spaces 14 or the second spaces 15 may be employed. Further, in lieu of the playing chips 21, the tokens 18 may be employed for securement in an end-to-end relationship, in a manner as indicated in FIG. 8, for enhanced visual impact in play of the game. Typically, such player tokens 18 are to indicate various runs and the like, but again may be employed in lieu of the chips 21. Stacking of the chips, as indicated in the FIGS. 11 and 12, may be utilized should a single player as a variation employ multiple runs along the same spaces of the first and second spaces 14 and 15.

Play accordingly is not limited to the manner as noted above, but may employ variations as agreed upon by the opposing players or teams thereof.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A board game apparatus, comprising, a game board, the game board including a matrix of first spaces and a matrix of second spaces, and at least one playing card deck, having playing cards in each of the first spaces and each of the second spaces, and indicative of playing cards of said playing card deck, and a plurality of tokens arranged for positioning upon individual spaces of said first spaces and said second spaces in association with cards selected from said playing card deck, and the tokens include a token base, a token body, and a token head, with a connecting web extending from a junction of said token head and said token body, wherein the connecting web is oriented parallel to said token base projecting laterally of said token, wherein the token web terminates in a resilient C-shaped connector end defining an arc greater than 180 degrees having an entrance gap of a predetermined spacing, wherein the connecting web is of a predetermined width substantially equal to the predetermined spacing permitting securement of adjacent tokens, wherein an individual entrance gap receives a further junction of an adjacent token therewithin, and token chips, wherein each of the token chips includes a chip top wall and a chip bottom wall, the chip top wall includes a chip projection, the chip bottom wall includes a chip recess, wherein the chip projection and the chip recess are coaxially aligned relative to said chip, and the token base includes a token base recess to receive said chip projection.

* * * * *